United States Patent [19]

Tamura et al.

[11] Patent Number: 5,056,995

[45] Date of Patent: Oct. 15, 1991

[54] DISPLACEMENT COMPRESSOR WITH REDUCED COMPRESSOR NOISE

[75] Inventors: Shigehiro Tamura, Toyota; Hideaki Yoshidomi, Chiryu; Toshio Takeda, Nagoya, all of Japan

[73] Assignee: Aisin Seiki Kabushiki Kaisha, Kariya, Japan

[21] Appl. No.: 483,668

[22] Filed: Feb. 23, 1990

[30] Foreign Application Priority Data

Feb. 28, 1989 [JP] Japan ..... 1-47039

[51] Int. Cl.[5] ..... F04C 18/16

[52] U.S. Cl. ..... 418/201.1

[58] Field of Search ..... 418/201.1, 203, 205, 418/206

[56] References Cited

U.S. PATENT DOCUMENTS 4,193,749 3/1980 Yamazaki et al. ..... 418/201.1
4,781,541 11/1988 Sohler et al. ..... 418/206

FOREIGN PATENT DOCUMENTS 54-30520 3/1979 Japan ..... 418/201.1
54-71412 6/1979 Japan ..... 418/201.1
309685 4/1929 United Kingdom ..... 418/206

*Primary Examiner*—John J. Vrablik
*Attorney, Agent, or Firm*—Oblon, Spivak, McClelland, Maier & Neustadt

[57] ABSTRACT

A displacement compressor has a housing defining a chamber and having an inlet and an outlet for the chamber. A pair of meshing helical rotors are rotatably supported about parallel axes in the chamber, so that a compressible fluid may be pumped from the inlet to the outlet. A recess in the wall of the housing is positioned in the chamber and around the outlet and has a substantially trapezoidal shape, in plan. The non-parallel edges of the substantially trapezoidal shape are angled with respect to the axial direction of the rotors, preferably by an angle which is substantially equal to the twist angle of the rotors. Noise producing pressure pulsations at the outlet are thereby reduced.

1 Claim, 6 Drawing Sheets

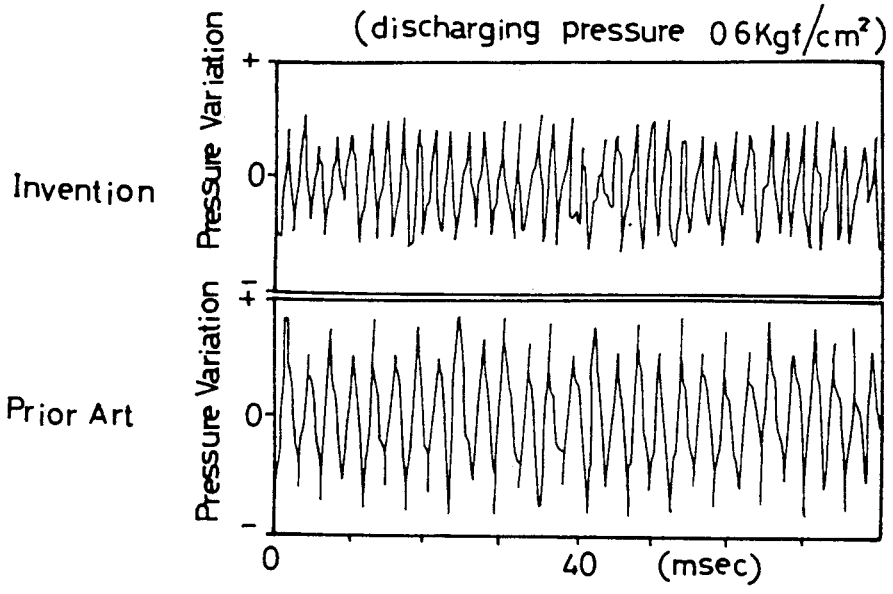
FIG. 5
FIG. 7
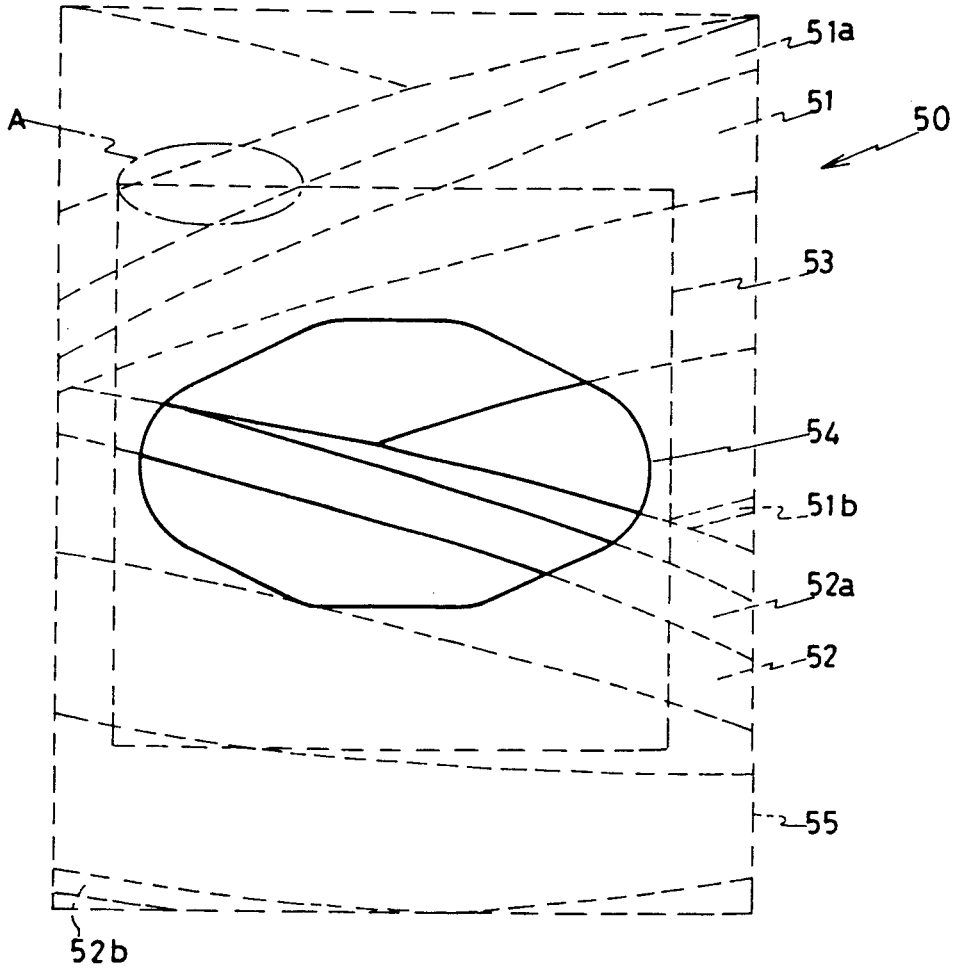

DISPLACEMENT COMPRESSOR WITH REDUCED COMPRESSOR NOISE

BACKGROUND OF THE INVENTION

1. Field of the Invention

The invention relates to a displacement compressor used as a supercharger for an automobile, a blower for an industrial machine, and so on.

2. Description of the Related Art

A displacement compressor is shown, for example, in the publication "TOKIKO REVIEW," Vol. 21, No. 4. This displacement compressor has a pair of rotors, each formed with two blades and having a zero degree twist angle. A recess 30 has a rectangle shape (shown in FIG. 8) and is formed in a chamber so as to be around an outlet 23 for the purpose of reducing the compressor noise. The recess 30 causes the operating chamber to open to the outlet 23 earlier and more gradually than in a compressor having no such recess. A rapid fluid flow from the operating chamber into the outlet 23 is thereby avoided or reduced. Therefore, pressure pulsations are reduced and the compressor noise is diminished.

FIG. 7 shows a device developed by the present inventors, which is not prior art with respect to the present application. It includes a displacement compressor 50 having a pair of three-blade helical rotors 51, 52 in a chamber 55, in which the fluid is exhausted continuously to the outlet 54 past the recess 53. Therefore, pressure pulsations are reduced and the compressor noise is diminished. Reference numerals 51*a* and 51*b* (52*a* and 52*b*) indicate seal faces of the rotors 51, (52). However, any noise reducing effect due to the recess 53 occurs at the region A in FIG. 7 and does not occur at any other part of the recess 53, because each rotor has a helical form and the recess 53 is a rectangle.

SUMMARY OF THE INVENTION

It is an object of the invention to provide a displacement compressor able to obviate the above mentioned drawbacks.

The above, and other, objects are achieved according to the present invention by a displacement compressor comprising a housing defining a chamber therein and having an inlet and an outlet for the chamber, and a pair of meshing helical rotors rotatably supported about parallel axes in the chamber for pumping a compressible fluid from the inlet to the outlet, as well as a recess in the wall of the housing, positioned in the chamber and around the outlet. The recess has a substantially trapezoidal shape, in plan, with non-parallel edges of the substantially trapezoidal shape being angled with respect to the axial direction of the rotors. As a result, noise producing pressure pulsations at the outlet are reduced.

According to a feature of the invention, each of the non-parallel edges forms an angle with respect to the axial direction of the rotors, which angle is substantially equal to a twist angle of the rotors.

According to yet a further feature of the invention, each of the non-parallel edges of the substantially trapezoidal shape is comprised of a plurality of step portions which together approximate a straight line having the angle.

BRIEF DESCRIPTION OF THE DRAWINGS

A more complete appreciation of the invention and many of the attendant advantages becomes better understood by reference to the following detailed description when considered in connection with the accompanying drawings, wherein:

FIG. 5 shows pressure characteristics in the outlet under 0.6 $Kgf/cm^2$ of the exhaust or discharge pressure of the displacement compressors in FIG. 1 and a prior art;

FIG. 7 shows a front view of a main part of a conventional compressor; and

DESCRIPTION OF THE PREFERRED EMBODIMENTS

Figure 1:
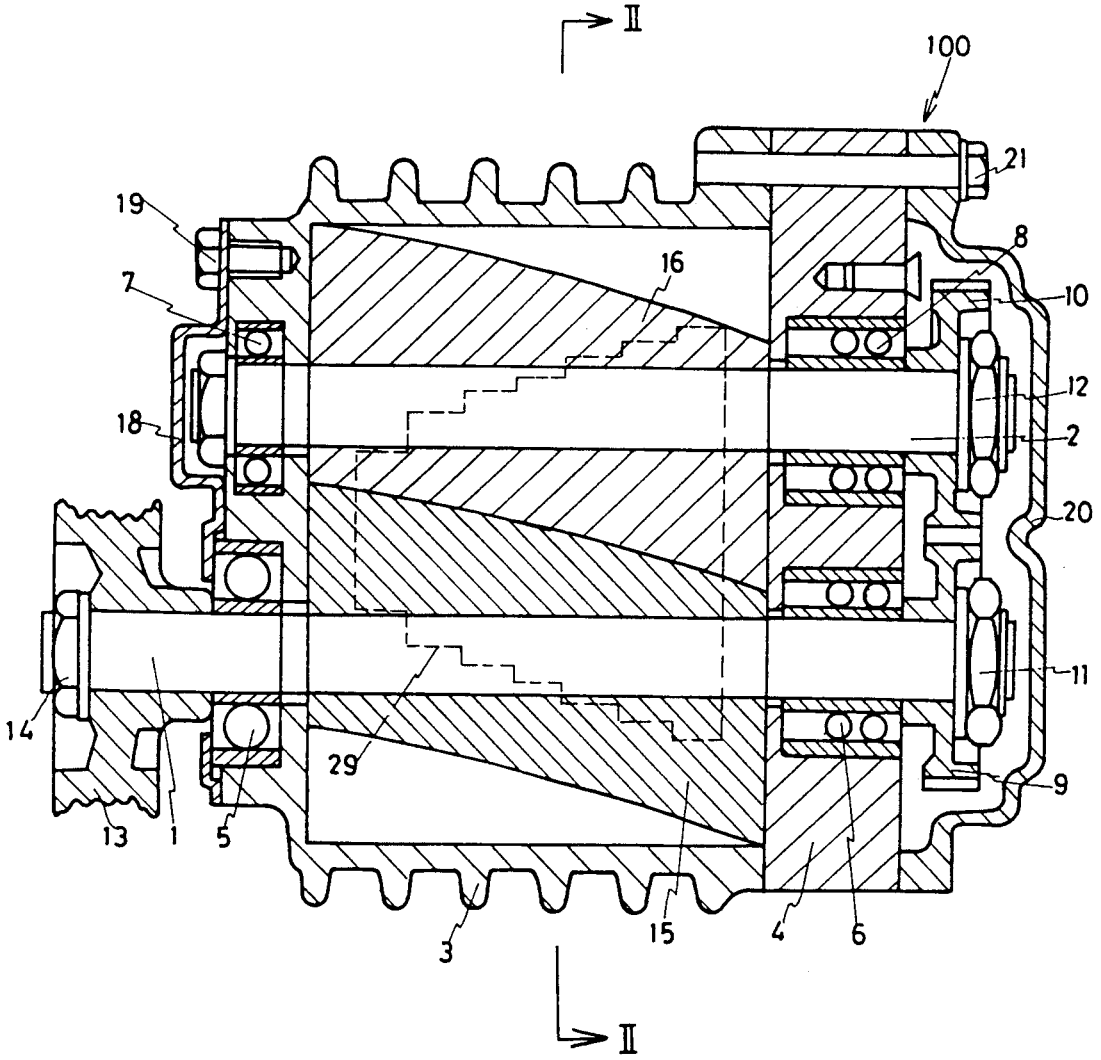
FIG. 1 shows a sectional view of a displacement compressor according to the invention.
Figure 2:
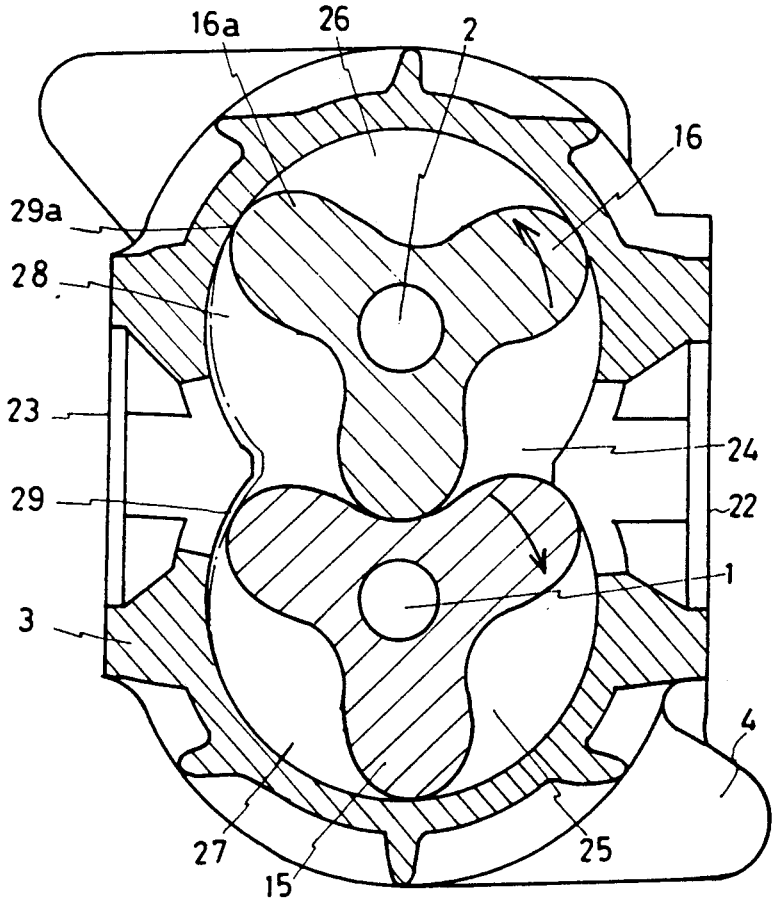
FIG. 2 shows a cross sectional view of a displacement compressor taken along line II-II in FIG. 1.
Figure 3:
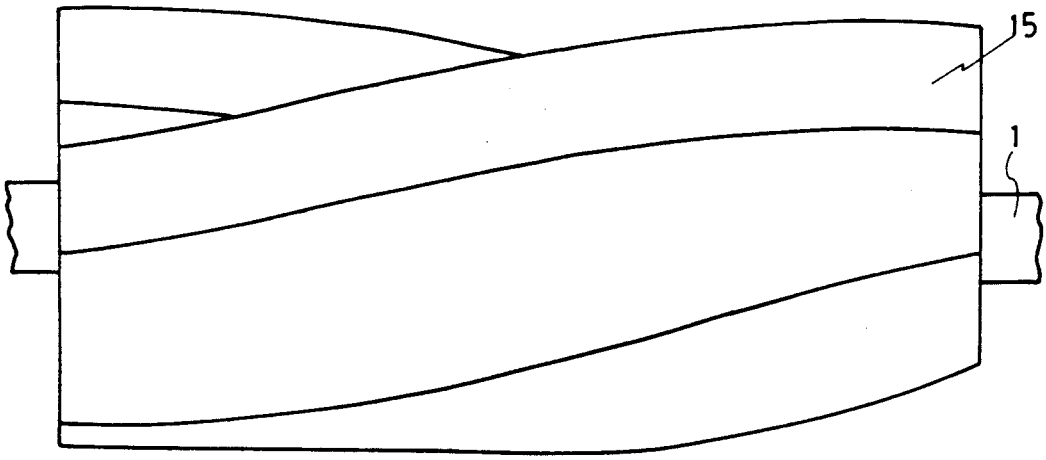
FIG. 3 shows a front view of a rotor used in the displacement compressor of FIG. 1.

In FIGS. 1–3, parallel shafts 1,2 mounting rotors 15, 16 are supported by a housing 3 and a sub-housing 4 by bearings 5, 6, 7, 8. On the right ends of the shafts 1, 2 (as seen in FIG. 1), timing gears 9, 10 are fixed by keys or splines (not shown in FIGS. 1–3) and nuts 11, 12. A pulley 13 is fixed on the left end of the shaft 1 by a key or splines (not shown in FIGS. 1–3) and a nut 14. Covers 18, 20 are attached to the ends of the housing 3 and the sub-housing 4 by bolts 19, 21. An inlet 22 and an outlet 23 are formed in the housing 3 in opposed positions across a chamber containing the rotors 15, 16.

Figure 4:
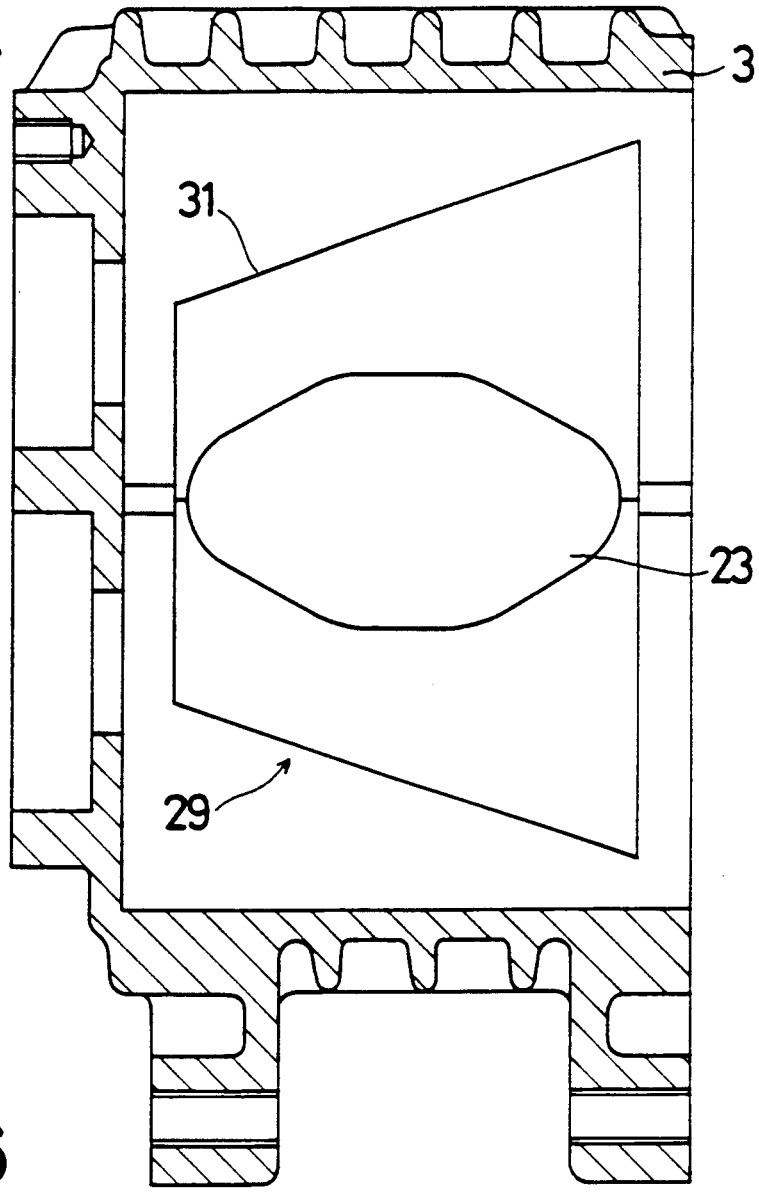
FIG. 4 shows an embodiment of grooves in a housing used for the displacement compressors in FIG. 1.

Around the outlet 23 and on the inside wall of the housing 3 which defines the chambers, is formed a recess 29. In seen FIG. 4, the recess 29 is formed in a trapezoid-form when seen in plan. As can be seen in FIG. 2, the edges 29*a* of the recess merge with the chamber wall at a line, and the depth of the recess 29 gradually increases from this line towards the outlet 23.

Figure 4A:
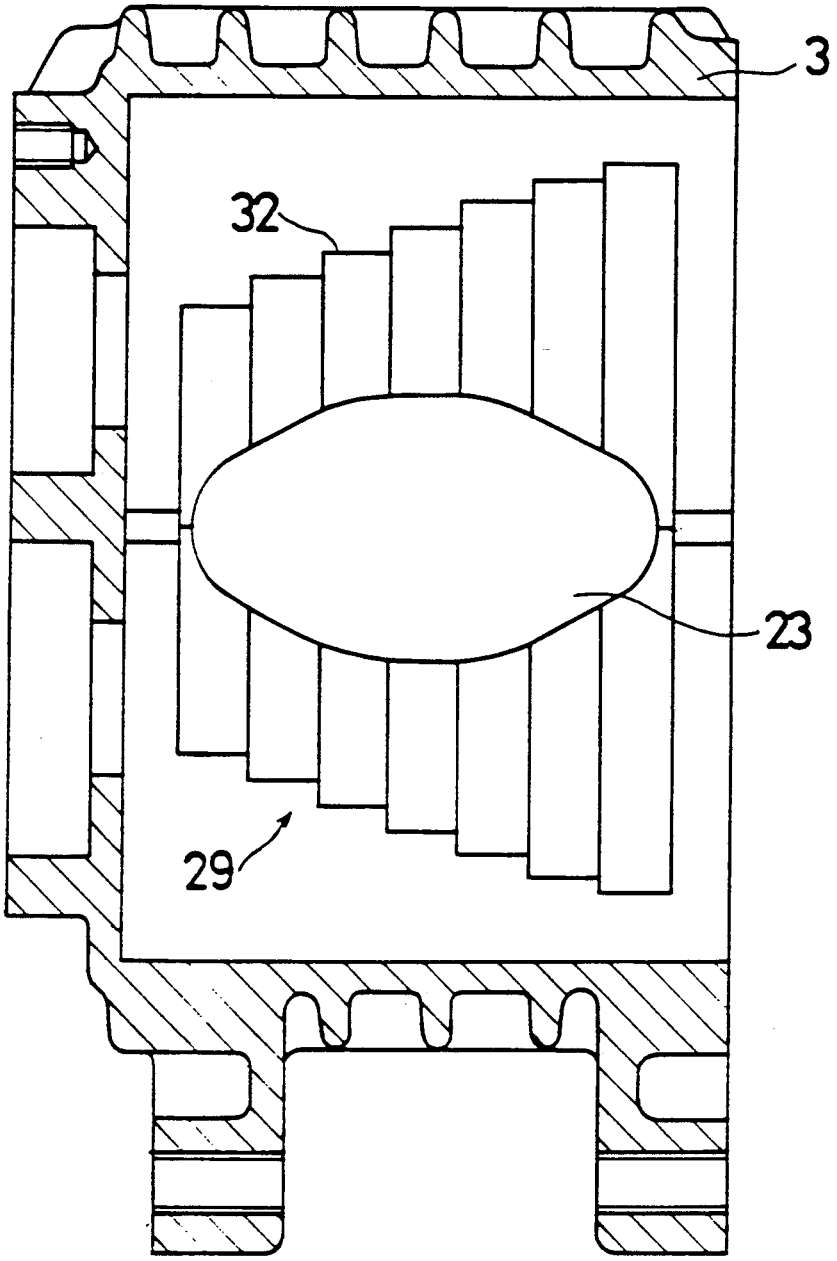
FIG. 4A corresponds to FIG. 4 but shows another embodiment.
Figure 8:
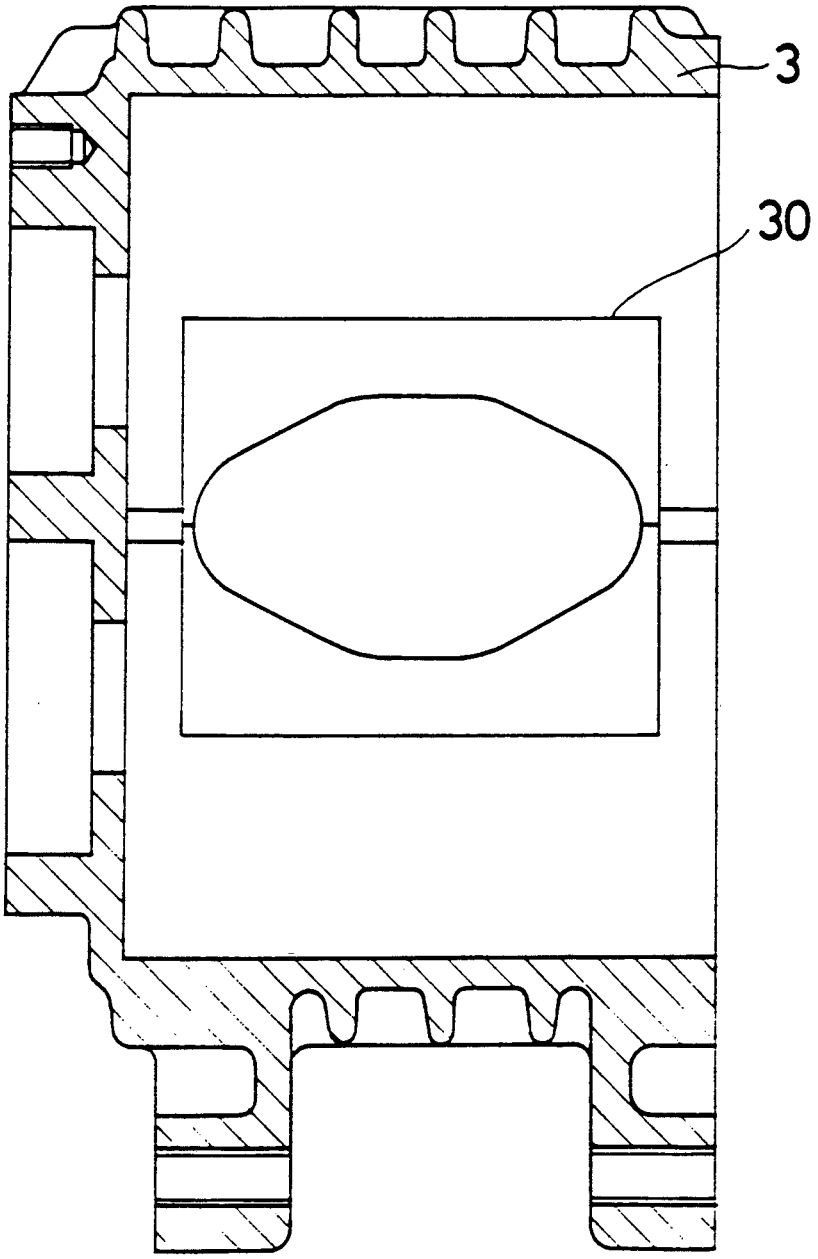
FIG. 8 PRIOR ART
FIG. 8 shows an example of the prior art.

The non-parallel edges 29*a* of the trapezoidal recess ideally form a straight line 31 having a slope angle with respect to the axial direction of the rotors which is equal to the twist angle of the helical rotor 15 (16). In light of the present or current manufacturing techniques, such a line 31 cannot be obtained. So, instead of this line 31, a stepped line 32 which approximates the line 31 may be employed, as shown in FIG. 4*a*.

In the above mentioned embodiment, the driving force is transmitted to the pulley 13 through a driving belt (not shown). The shaft 1 rotates with the rotor 15 and the timing gear 9 in the clockwise direction in FIG. 2, and the shaft 2 rotates with the rotor 16 and the timing gear 10 in the counterclockwise direction in FIG. 2. With the rotation of the rotors 15, 16, the fluid in the inlet 22 is drawn into the operating chambers 24, 25. With the further rotation of the rotors 15, 16, the fluid is continuously transported to the positions of the operating chamber 26, 27, 28, and is finally exhausted via the outlet 23. The exhaust of the fluid in the operating chambers 26 begins gradually, when the top 16*a* of a blade of the rotor 16 arrives at the edge 29*a* of the recess 29. Therefore the gradual exhaust of the fluid prevents a too rapid fluid-flow from the operating chambers into the outlet 23 and reverse-flow from the latter to the former. Thus, pressure pulsations are reduced and the compressor noise is diminished.

Figure 6:
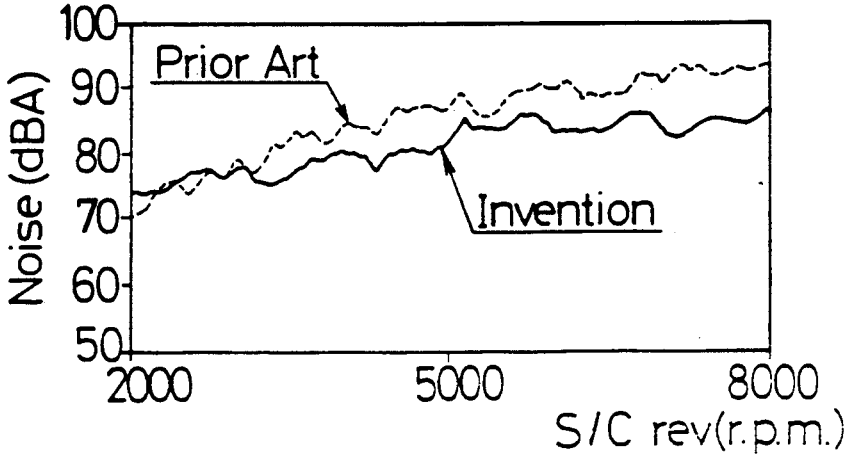
FIG. 6 shows noise levels at a 0.6 $Kgf/cm^2$ of the exhaust pressure and at a rotational speed of 2000–8000 rpm of the rotor, according to the displacement compressors in FIG. 1 and a prior art.

Hereinafter, remarkable effects of this invention will be detailed with reference to FIGS. 5 and 6. FIG. 5 illustrates how the discharging pressure of 0.6 Kgf/cm$^2$ varies or changes at the outlet 23 in the present invention and the prior art of Tokiko Review, Vol 21, No. 4. As apparent from FIG. 5, pressure-pulsations are effectively or remarkably decreased in the present invention in comparison with the prior art. FIG. 6 illustrates the results of noise measuring experiments by using devices according to the present invention and the same prior art as in FIG. 5, under common conditions in which the discharging pressure is set at 0.6 Kgf/cm$^2$ and the rotor is rotated at a speed ranging from 2000 to 8000 rpm. As seen from FIG. 6, noise is reduced in the present invention in comparison with the prior art. The effect in noise reduction is most remarkable at a high-speed revolution region in the illustrated embodiment.

Whether the noise reduction is most noticeable in a high speed rotation range or a low speed rotation range can be easily changed by adjusting or controlling the maximum radial depth of the recess 29. A large depth causes greater noise reduction in a high speed rotation range, and a small depth maximizes noise reduction in a low speed rotation range.

Obviously, numerous modifications and variations of the present invention are possible in light of the above teachings. It is therefore to be understood that within the scope of the appended claims, the invention may be practiced otherwise that as specifically described herein.

What is claimed as new and desirable to be secured by Letters Patent of the U.S. is:

1. A displacement compressor comprising:

a housing defining a chamber therein and having an inlet and an outlet for the chamber;

a pair of meshing helical rotors rotatably supported about parallel axes in said chamber, whereby a compressible fluid may be pumped from the inlet to the outlet; and a recess in the wall of said housing, said recess being positioned in the chamber and around the outlet, wherein said recess has a substantially trapezoidal shape, in plan, with non-parallel edges thereof being angled with respect to the axial direction of said rotors, whereby noise producing pressure pulsations at the outlet are reduced, wherein each of said non-parallel edges forms an angle with respect to the axial direction of said rotors, said angle being substantially equal to a twist angle of said rotors, and wherein each of said non-parallel edges of said substantially trapezoidal shape is comprised of a plurality of stepped portions which together approximate a straight line having said angle.

* * * * *